United States Patent [19]

Dickler

[11] 4,066,195

[45] * Jan. 3, 1978

[54] LOCKING MECHANISM FOR TAMPER-PROOF BACKPACK OR PIECE OF LUGGAGE

[76] Inventor: Paul J. Dickler, 37 W. 8th St., New York, N.Y. 10011

[ * ] Notice: The portion of the term of this patent subsequent to July 1, 1993, has been disclaimed.

[21] Appl. No.: 621,870

[22] Filed: Oct. 14, 1975

Related U.S. Application Data

[63] Continuation-in-part of Ser. No. 436,491, Jan. 25, 1974, Pat. No. 3,960,300.

[51] Int. Cl.[2] ..... A45F 3/04

[52] U.S. Cl. ..... 224/8 R; 224/46 R; 70/76; 70/15; 190/41 R

[58] Field of Search ..... 224/8 R, 8 A, 9, 25 A, 224/46 R, 47, 43, 44, 45 S; 190/60, 26, 41 R; 70/15, 76, 18, 49, 30, 233, 234; 211/4; 150/52 R

[56] References Cited

U.S. PATENT DOCUMENTS

| | | | |
|---|---|---|---|
| 1 394,673 | 10/1921 | Doyle | 70/18 X |
| 2,180,117 | 11/1939 | Lipsis | 70/234 X |
| 3,960,300 | 6/1976 | Dickler | 224/8 R |

FOREIGN PATENT DOCUMENTS

| | | | |
|---|---|---|---|
| 725,318 | 5/1932 | France | 70/15 |

*Primary Examiner*—Robert J. Spar
*Assistant Examiner*—Jerold M. Forsberg

[57] ABSTRACT

A tamper-proof backpack is disclosed which is formed of plastic or similar molded construction. The backpack includes a concave rear wall and shoulder straps which enable the backpack to be carried on the back of a user. The backpack may also be hand-carried and a cover is provided for fitting over the concave rear wall thereby hiding the shoulder straps when the backpack is so carried. The backpack includes a locking mechanism which prevents unauthorized access into the interior of the backpack and which also enables the backpack to be secured to a stationary object. The locking mechanism may also be used to secure a conventional luggage-suitcase or similar article to a stationary object.

9 Claims, 8 Drawing Figures

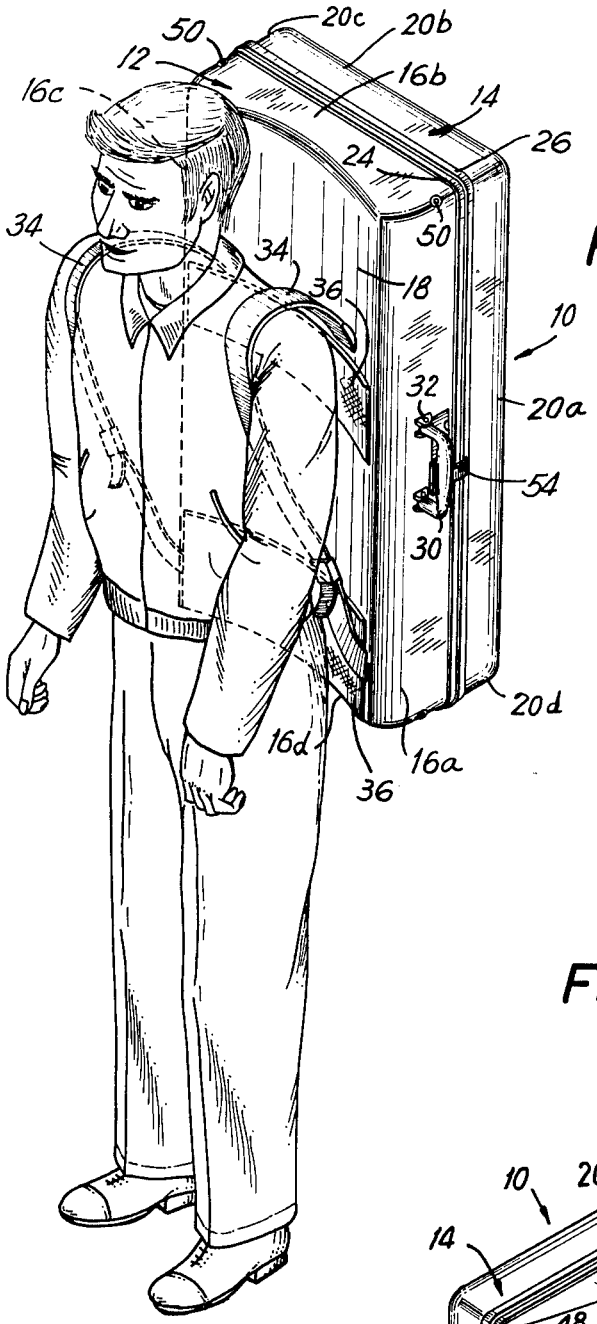
FIG.1
FIG.2
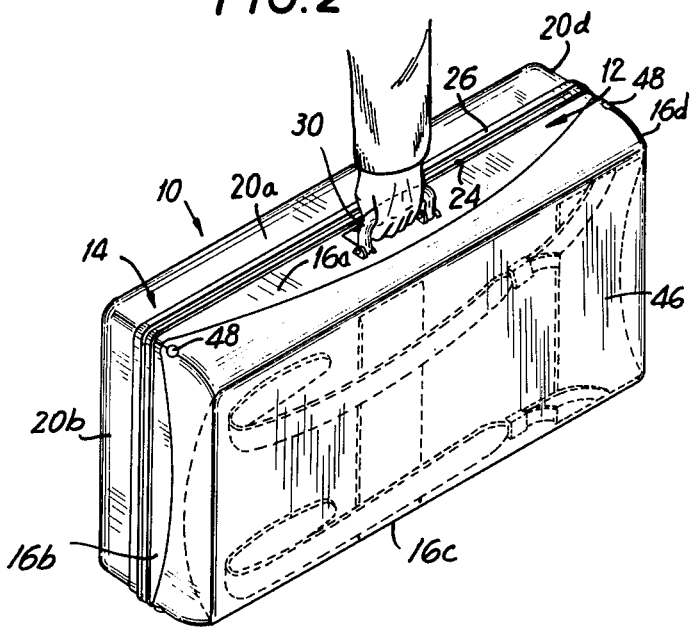

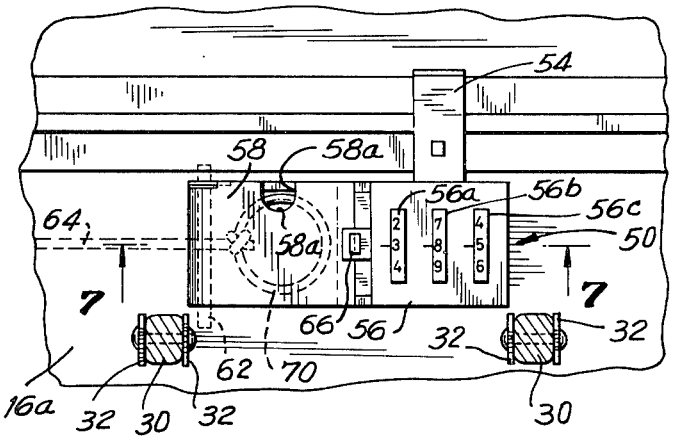
FIG.6
FIG.7
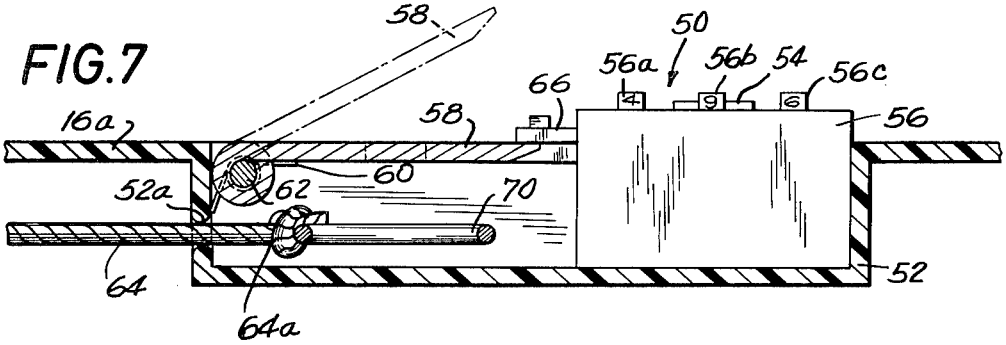
FIG.8
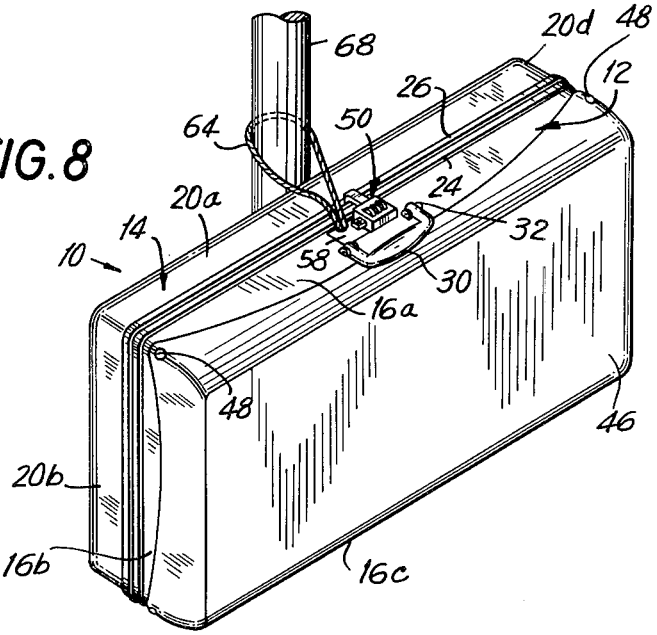

LOCKING MECHANISM FOR TAMPER-PROOF BACKPACK OR PIECE OF LUGGAGE

This application is a continuation-in-part of application Ser. No. 436,491 filed Jan. 25, 1974, now U.S. Pat. No. 3,960,300.

This invention relates generally to backpacks and, more particularly, to a tamper-proof backpack formed of a plastic or molded type construction. It also relates to a mechanism for securing said backpack or a piece of conventional luggage to a stationary object.

There has been a tremendous increase, over the past few years, in camping, hiking and similar low-cost travelling from one place to another. Thus, the number of people who camp across the United States and/or camp from country to country abroad each year is significant. The prime piece of equipment utilized in these travels is a knapsack or backpack, which is carried on the traveler's back and utilized to store camping equipment, clothing and the like.

Conventional backpacks are formed of a canvas or other non-rigid material having a collapsible shape. There are several disadvantages in using this type of backpack. First, if the backpack is relatively large in size and if it is utilized to store a large amount of material, a separate backpack frame must be provided for enabling the backpack to be carried on the back and shoulders of a user. Second, there is frequently a stigma which attaches to the use of a backpack in metropolitan or suburban areas, such as in populated cities and the like. Thus, when the traveler reaches a city, for example, if he is travelling from city to city in the United States or in a foreign country, it is often inappropriate to utilize the backpack. Third, and most important, is the fact that conventional backpacks are subject to tampering and unauthorized access — it is easy for a less than honest person to open the backpack (or cut through it) to hunt through the canvas backpack, if left unattended, in order to steal the backpack's contents. In addition, the entire backpack, if left unattended, may be stolen since no way is provided to secure the backpack to a stationary object, be this object a tree at a campsite, a bedpost in a hotel room, or a pipe at a railroad or train station.

Accordingly, it is a broad object of the present invention to provide a backpack which overcomes the above disadvantages of canvas or similar backpacks of the prior art.

A more specific object of this invention is to provide a backpack formed of a plastic or similar molded construction which is relatively tamper-proof, but which is nonetheless relatively lightweight.

Another object of this invention is to provide a tamper-proof backpack which includes a locking mechanism for securing the backpack to a stationary object. This mechanism may also be used to secure a conventional piece of luggage to the stationary object.

Yet a further object of this invention is to provide a backpack which does not require a separate backpack frame.

Another object of the present invention is to provide a backpack which is sturdy in construction and relatively inexpensive to manufacture.

In accordance with the present invention, there is provided a tamper-proof backpack which is formed of a molded plastic or similar type material and which includes a backpack body and a backpack cover hingedly connected thereto. The backpack body includes side walls and a generally concave rear wall which is opposite to and spaced from the backpack cover, and which is adapted to receive shoulder straps to enable the backpack to be carried on the back of the user. At least one flexible cross-support strip, connected between opposite edges of the concave rear wall, is provided to facilitate the backpack being carried on a user's back. The backpack may also be hand-carried and a handle is provided, along one of the sides of the backpack body, for carrying the backpack in this position. A flexible second cover, removably connected to the backpack body, fits over the concave rear wall for hiding the shoulder straps when the backpack is hand-carried. The backpack includes a locking mechanism for securing the backpack cover to the backpack body, which locking mechanism also includes a removable cable adapted to be looped-around a stationary object to secure the backpack in place. The locking mechanism may also be utilized with a piece of conventional luggage such as a suitcase, attache case, etc.

The above description of the present invention will be more fully appreciated by reference to a following detailed description of a preferred, but nonetheless illustrative embodiment, when taken in conjunction with the accompanying drawings, wherein:

FIG. 1 is a front perspective view of a backpack according to the present invention, showing the backpack worn on a user's back;

FIG. 2 is a front perspective view of the backpack, showing the backpack hand-carried;

FIG. 6 is a partial top plan view, showing a locking mechanism useful with the backpack or piece of luggage of the present invention;

FIG. 7 is a partial sectional view, enlarged in scale, and taken along the line 7–7 of FIG. 6; and FIG. 8 is a front perspective view of the backpack, showing the backpack secured to a stationary object.

Figure 3:
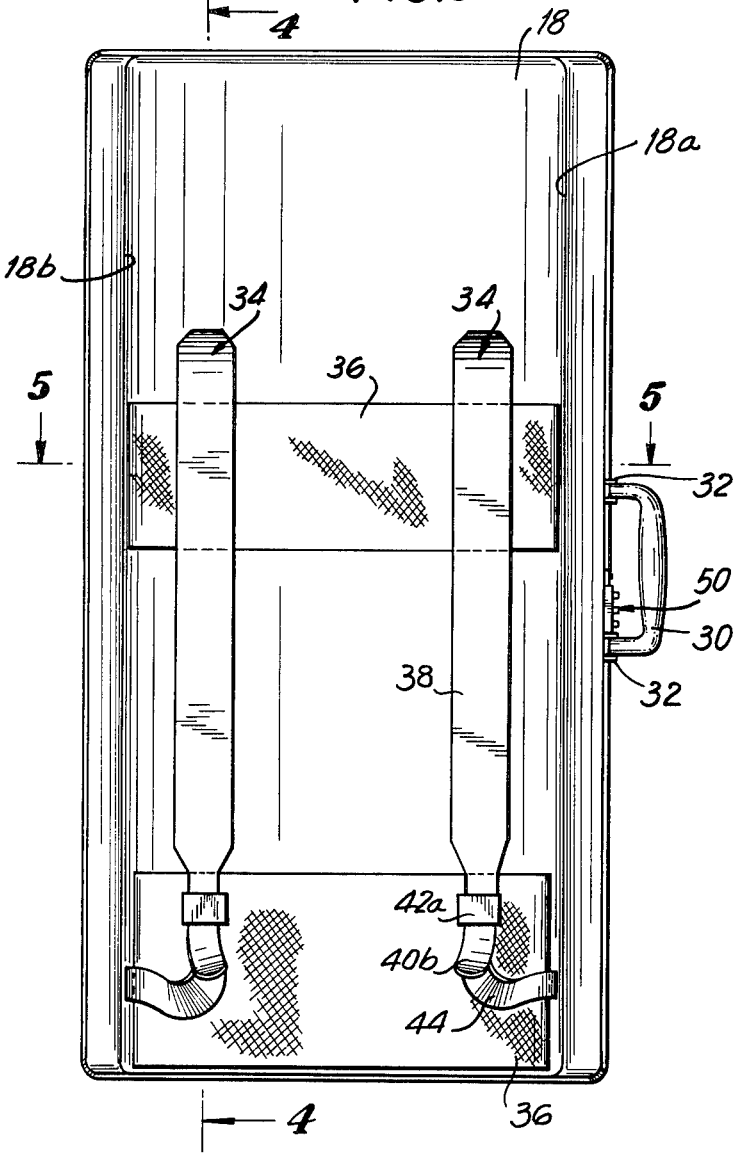
FIG. 3 is a front elevation view of the backpack of FIG. 1.

Referring now to the drawings and, more particularly, to FIGS. 1 and 2 thereof, a backpack cover according to the present invention is generally designated 10. Backpack 10 is of a plastic or similar molded construction, which forms a backpack body, generally designated 12, and a backpack cover, hingedly connected to the backpack body, and generally designated 14. The backpack is formed of a material so that the backpack body and backpack are self-supporting, maintaining a generally fixed yet somewhat resilient shape.

Backpack body 12 defines adjacent side walls, 16*a*, 16*b*, 16*c* and 16*d*, with side wall 16*a* and 16*c* spaced from and generally parallel to each other and side walls 16*b* and 16*d* also spaced from and generally parallel to each other. A generally concavely shaped rear wall 18 forms the fifth side of the backpack body, with the concave rear wall enabling backpack 10 to be carried on the back of a user, as illustrated in FIG. 1 and as will be more fully explained hereinafter. Backpack cover 14 likewise includes four side walls, 20*a*, 20*b*, 20*c* and 20*d*, with the backpack cover being completed by a substantially flat top wall 22 (see FIG. 5).

Backpack cover 14 is hingedly connected to backpack body 12, for example, along the juncture of side walls 16c, 20c, so that the backpack cover may be either swung-open to provide access to the interior of backpack 10 or swung-closed to maintain material within the backpack. A metal molding 24, disposed along the edges of side walls 16a – 16d cooperates with a corresponding metal molding 26, disposed on the edges of side walls 20a – 20d, to provide an adequate closure or seal between backpack body 12 and backpack cover 12. A hinge connection 28, illustrated schematically in FIG. 5, is disposed along moldings 24, 26, at side walls 16c, 20c, to provide the requisite hinge connection between the backpack body and the backpack cover.

As illustrated in FIGS. 1 and 2, backpack 10 has the dual capability of being carried on the back and shoulders of a user (FIG. 1), or being hand-carried (FIG. 2). For hand-carrying the backpack, the backpack includes a conventional handle 30, which is swingably mounted on side wall 16a, for example, in handle brackets 32. For carrying backpack 10 on the back and shoulders, the backpack includes adjustable shoulder straps 34 and flexible cross-support strips 36, which are disposed at concave rear wall 18.

Figure 4:
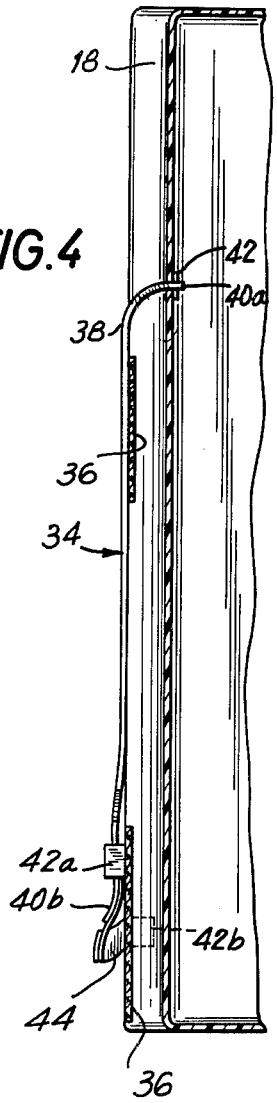
FIG. 4 is a partial sectional view, taken substantially along the line 4—4 of FIG. 3.
Figure 5:
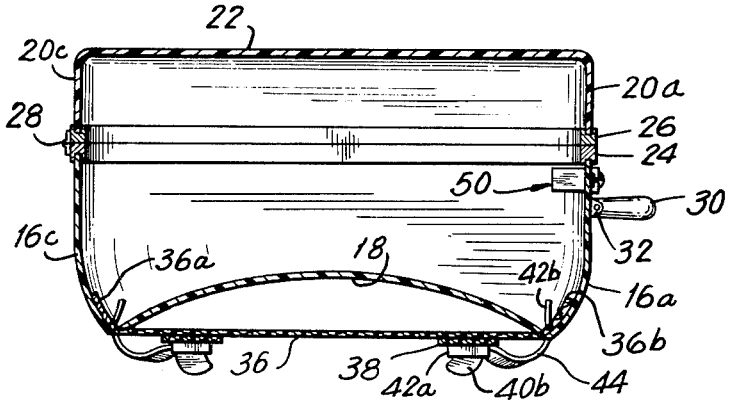
FIG. 5 is a sectional view, taken substantially along the line 5—5 of FIG. 3.

Specifically, and referring to FIGS. 3–5, the backpack includes two adjustable shoulder straps 34, of identical construction, and of generally conventional design. By way of example, each of the shoulder straps 34 includes a top strap 38 having a tapered end portion 40a inserted into an appropriate slit (not shown) in concave rear wall 18, with the tapered end portion being secured to the interior of the backpack at the concave rear wall by appropriate stitching or rivets 42 (see FIG. 4). The other end of top strap 38 is also tapered to provide a tongue portion 40b adapted to fit through a loop 42a carried at one end of a bottom strap 44. The other end 42b of the bottom strap is likewise securely connected to the backpack, for example, by inserting the end 42b of the bottom strap through an appropriate slit (not shown) located near the edges 18a, 18b of the concave rear wall. It should be noted that the adjustable straps 34 are fastened to the concave rear wall 18 in a manner sufficient for the straps to be placed on the shoulders of a user, whereby backpack 10 may be supported on the shoulders so that the backpack may be carried on the user's back. Thus, the tapered ends 40a of each of the top straps are spaced from each other a sufficient distance to enable the top straps to fit over, and rest upon, the shoulders and the ends 42b of the bottom straps are separated from each other at a somewhat larger distance, in order for the straps to clear the back of a user.

As illustrated in FIGS. 3–5, at least one flexible cross-support strip 36 is also provided at concave rear wall 18 of the backpack. As shown in FIG. 3, two such strips 36 are provided, with one of the strips stretching across concave rear wall 18 slightly below the point at which the top straps 38 are secured to the wall, e.g., the flexible strip is slightly above the midpoint of the concave rear wall as viewed in FIG. 3. The other flexible cross-support strip 36 is stretched across the concave rear wall near the bottom of the wall as viewed in FIG. 3. Each of the flexible cross-support strips 36 is stretched between the edges 18a, 18b of the concave rear wall 18, with the cross-support strips being secured to the backpack, for example, by having the ends of the strips inserted into appropriate slits (not shown) disposed at edges 18a, 18b. The ends 36a, 36b of the cross-support strips may then be secured to the inside of the backpack, for example, by securing these ends to the side walls of the backpack (see FIG. 5) or by lacing the ends to each other (not shown).

It will be appreciated that the cross-support strips 36 function to provide a cushion between concave rear wall 18 and a user's back, when the backpack is carried by shoulder straps 34 on the back of the user. The somewhat flexible nature of the cross-support strips (the strips may be formed of a nylon mesh or similar material), enables the strips to absorb some of the jolts and bumps which arise as the backpack is carried on the user's back. In addition, the cross-support strips conform to the shape of a user's back, thereby enabling the backpack to be used by different persons. Still further, the strips provide a path for the flow of air, between the user's back and concave rear wall 18, thereby increasing the comfort of the backpack, especially when the same is used in hot weather.

As indicated hereinbefore, it is often more appropriate to carry a piece of hand luggage when a traveller is in a metropolitan area than it is for the traveller to use a backpack. Accordingly, besides providing handle 30 for hand-carrying the backpack, the backpack also includes an appropriately shaped flexible cover 46, which is adapted to fit over concave rear wall 18 to hide shoulder straps 34 and cross-support strips 36 so that the backpack not only can be carried easily by storing the straps, but also so that the backpack can resemble a conventional piece of hand luggage.

Cover 46 is secured over concave rear wall 18 by a series of snaps 48 at the four corners of the cover, which snaps are adapted to cooperate with corresponding snaps 50 disposed on the outside of backpack body 12 (see FIG. 1). Cover 46 should be the same color as the color of backpack body 12 so that when cover 46 is placed over the concave rear wall, the backpack resembles a more conventional piece of hand luggage. Cover 46 should also be fabricated of a nylon, canvas or similar material, thereby enabling the cover to be folded up and stored within the backpack when the cover is not in use, as for example, when the backpack is being worn on a user's back.

Backpack 10 includes a locking mechanism, generally designated 50, which is provided to lock backpack body 12 to backpack cover 14 thereby preventing the unauthorized removal of material from the interior of the backpack. The locking mechanism also enables the backpack to be secured to a stationary object thereby greatly preventing the backpack, itself, from being stolen. Although the following refers to the locking mechanism in the context of a molded backpack, it will be understood that this mechanism may be used in a "conventional" piece of luggage, for example, in a suitcase, attache case, etc., whether "molded" or non-molded. Hence, reference in the following description to "backpack" should also include a piece of conventional luggage.

Referring specifically to FIGS. 6–8, locking mechanism 50 is disposed within an appropriate U- or similar shaped well 52 formed in side sall 16a of the backpack or luggage body. A latch 54, connected between body 12 and cover 14, is responsive to a conventional tumbler mechanism 56 so that when the correct combination is selected on tumblers 56a–56b, the latch, which may be spring-loaded, springs up to unlock the cover from the body, as is generally understood. It will be appreciated that latch 54 is shown rather schematically in the drawings and that other types of latches, responsive to tumbler mechanism 56, may be provided if so desired.

The locking mechanism 50 also includes a well or cable cover 58, which is spring-loaded, by way of a spring 60, so that the well cover is biased to rotate about an axis 62 to expose well 52. As illustrated in FIG. 6, well cover 58 includes a notch or cutout 58*a* through which is drawn a cable 64 to be fastened to a stationary object, as will be explained hereinafter. Well cover 58 is maintained in its closed position, illustrated in solid-line in FIG. 7, by a latch 66 which is also responsive to the combination set in tumbler mechanism 56. Thus, when the proper combination is selected on tumblers 56*a*–56*c*, latch 66 is operable to release well cover 58, with the well cover springing-open to assume an open position, illustrated in broken line in FIG. 7.

Cable 64 is provided to secure backpack or luggage piece 10 to a stationary object, such as a bedpost, pipe, piece of furniture, tree or the like, illustrated schematically at 68 in FIG. 8, with the cable being wrapped around the stationary object to prevent backpack or luggage piece 10 from being stolen. One end of cable 64 (not shown) is secured to the inside of the backpack or luggage, while the other end 64*a* of the cable is inserted, through an aperture 52*a*, into well 52. Cable end 64*a* is secured to a ring 70, which fits in well 52 beneath well cover 58, and which functions as an abutment to prevent cable 64 from being withdrawn through aperture 52*a* into the interior of the backpack or luggage piece and also to prevent cable end 64*a* from being withdrawn, through notch 58*a*, from well 52.

Specifically, when it is desired to secure backpack or luggage piece 10 to a stationary object, tumblers 56*a*–56*c* are positioned to release latch 66 which, in turn, causes well cover 58 to spring open. Ring 70 is grasped and a length of cable is withdrawn from well 52. (Enough slack is provided on cable 64 to enable a predetermined length of cable to be withdrawn.) As illustrated in FIG. 8, cable 64 is then wrapped around stationary object 68, the ring 70 is reinserted into well 52, well cover 58 is closed and the tumbler is mixed so that the well cover is maintained in its closed and locked position. That portion of cable that extends from well 52, to wrap around the stationary object, fits through notch 58*a*, as illustrated in FIG. 8, and ring 70 prevents the end 64*a* of the cable from being withdrawn through notch 58*a* to unwind the cable about the stationary object.

It will be appreciated that the present invention provides a tamper-proof backpack having the dual capability of being either carried on a user's back or hand-carried. Thus, concave rear wall 18, as well as the use of shoulder straps 34 and cross-support strips 36, enables the backpack to be worn on a user's back, as illustrated in FIG. 1. This is especially advantageous when the backpack is used for camping, long hikes and the like. On the other hand, the backpack may be hand-carried, as illustrated in FIG. 2, with cover 46 fitting over the concave surface to hide the shoulder straps and cross-support strips, so that the backpack now resembles a more conventional piece of luggage, carried by handle 30. This is advantageous, for example, when the backpack is being used in a more populated area or when the backpack is used at a train station, hotel, airport and the like. Whether it is back or hand-carried, the backpack is substantially tamper-proof since it is fabricated of a molded plastic or similar material, which not only prevents someone from cutting into the backpack, but which provides a backpack which is relatively light in weight and relatively inexpensive to manufacture. Still further, the use of the locking mechanism provides a further tamper-proof feature for the backpack or conventional piece of luggage since not only does this provide a secure seal or lock between cover 14 and body 12 (mere straps are used in conventional canvas-type backpacks), but the backpack or luggage may also be secured to a stationary object, by using cable 64.

Specifically, it will be appreciated that the locking mechanism may be incorporated not only into a backpack but also into a piece of luggage formed with a luggage body 12, a luggage cover 14, etc. In fact, the above description should be read in such a context wherein the backpack straps are eliminated and the backpack body 12 formed to provide a "flat" back wall, as indicated by cover 46 in FIGS. 2 and 8.

Obviously, numerous modifications will be apparent in light of the above disclosure. By way of example, locking mechanism 50 may be key-operated, in order to operate latches 54 and 66. Similarly, separate locks, whether tumbler of key-operated, may be provided with one lock for releasing well cover 58 and the other for locking backpack cover 14 to backpack body 12. Still further, a rope or chain or any other cable-like member may be used as the securing member and substituted for cable 64. Similarly, one end of cable 64 may be secured to the outside of the luggage body so that only end 64*a* need be inserted into the luggage interior. Finally, the cable "notch" may be defined in the luggage body rather than in the well cover 58. It is to be appreciated, therefore, that the above-described embodiment is merely illustrative of the present invention, and other embodiments will be apparent to those skilled in the art without departing from the present invention, as set forth in the appended claims.

What is claimed is:

1. A piece of luggage comprising a body having side walls and a rear wall defining a space for storing material, a cover connected to one of said side walls and adapted to swing from a closed position to an open position providing access to said storage space, locking means for securing said cover to said body in its closed position, and means for securing said piece of luggage to a stationary object, said stationary object securing means including a well defined in one of said side walls, said well including an aperture opening to said storage space, a securing member having a first end permanently maintained within said storage space exterior of said well and having a second end inserted in said well through said aperture, a cover for said well permanently connected to said piece of luggage and adapted to move from a closed position to an open position, said well cover and said well defining a notch for enabling said securing member to extend from said well when said well cover is closed, wherein said second end of said securing member is adapted to be withdrawn from said well when said well cover is opened with said securing member sliding through said aperture, said securing member being wrapped around said stationary object and said second end of said securing member being reinserted back into said well and said well cover being closed to maintain said securing member looped around said stationary object, and an abutment disposed at said second end of the securing member for preventing withdrawal of said second end through said notch when said well cover is closed and further for preventing withdrawal of said second end through said aperture and back into the storage space.

2. A tamper-proof piece of luggage according to claim 1 wherein said body and said cover are formed of a plastic, resilient material.

3. A tamper-proof piece of luggage according to claim 1 wherein the first end of the securing member is connected within the storage space and the second end of the securing member is adapted to be withdrawn from the storage space wrapped said stationary object and thereafter inserted back into said storage space.

4. A tamper-proof piece of luggage according to claim 1 wherein said securing member is a cable.

5. A piece of luggage according to claim 1 further comprising means for locking the well cover in its closed position.

6. A piece of luggage according to claim 5 further comprising means for biasing said well cover in its open position.

7. A piece of luggage according to claim 6 wherein said well locking means includes a latch for maintaining said well cover in a closed position against the action of the biasing means.

8. A piece of luggage according to claim 7 wherein the well cover is hingedly connected to the well.

9. A tamper-proof piece of luggage comprising a body having side walls and a rear wall defining a space for storing material, a cover connected to one of said side walls and adapted to swing from a closed position to an open position providing access to said storage space, first locking means for securing said cover to said body in its closed position, and second locking means for securing said piece of luggage to a stationery object, said second locking means including a locking mechanism, a well defined in one of said side walls, said well including an aperture opening to said storage space, a cable adapted to slide through said aperture and having a first end disposed within said storage space exterior of said well and having a second end disposed in said well, a hingedly connected cover for said well adapted to open and close responsive to said locking mechanism, said well cover including a notch for enabling said cable to extend from said well when said well cover is closed, wherein said second cable end is adapted to be withdrawn from said well when said well cover is opened, said cable being adapted to be wrapped around said stationary object and said second cable end being reinserted back into said well, an abutment disposed at said second cable end for preventing withdrawal of said second cable end through said notch when said well cover is closed and after said second cable end has been reinserted back into said well, said abutment further preventing withdrawal of said second cable end through said aperture and back into the storage space prior to said second cable end being reinserted back into said well.

* * * * *